US012618562B1

(12) United States Patent
Snyder

(10) Patent No.: US 12,618,562 B1
(45) Date of Patent: May 5, 2026

(54) OPTIMIZED FRONT END AERODYNAMICS FOR ADVANCED RQL COMBUSTOR

(71) Applicant: RTX Corporation, Farmington, CT (US)

(72) Inventor: Timothy Snyder, Glastonbury, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 19/255,481

(22) Filed: Jun. 30, 2025

(51) Int. Cl.
*F23R 3/14* (2006.01)

(52) U.S. Cl.
CPC ..... *F23R 3/14* (2013.01)

(58) Field of Classification Search
CPC ..... F23R 3/14; F23R 3/12; F23R 3/04; F23R 3/283; F23R 3/286; F23R 3/425; F23R 3/46
See application file for complete search history.

(56) References Cited

U.S. PATENT DOCUMENTS

| | | | | |
|---|---|---|---|---|
| 5,479,782 | A | 1/1996 | Parker et al. | |
| 8,640,463 | B2 | 2/2014 | Cheung | |
| 9,765,969 | B2 | 9/2017 | Graves et al. | |
| 11,635,209 | B2 | 4/2023 | Vukanti et al. | |
| 2012/0234013 | A1* | 9/2012 | Overman | F23R 3/283 60/746 |
| 2019/0137103 | A1* | 5/2019 | Choi | F23R 3/286 |
| 2021/0172604 | A1* | 6/2021 | Locke | F23R 3/286 |
| 2023/0204213 | A1 | 6/2023 | Naik et al. | |

* cited by examiner

*Primary Examiner* — Rodolphe Andre Chabreyrie
(74) *Attorney, Agent, or Firm* — Kinney & Lange, P.A.

(57) ABSTRACT

An injector for a combustor and a gas turbine engine with the same includes a stem extending from a mount to a nozzle and a swirler. The nozzle extends from the stem along an axis. The nozzle includes a center body and a fuel passage. The swirler circumscribes the nozzle and includes an inner air passage and an outer air passage. An array of circumferentially-spaced inner vanes within the inner air passage each form an inner acute angle with the axis. An array of circumferentially-spaced outer vanes within the outer air passage each form an outer acute angle less than the first acute angle.

17 Claims, 4 Drawing Sheets

OPTIMIZED FRONT END AERODYNAMICS FOR ADVANCED RQL COMBUSTOR

BACKGROUND

The present disclosure relates generally to combustion for gas turbine engines, and more particularly, to features of injectors and combustors that reduce front end combustor liner and shell temperatures during rich-quench-lean ("RQL") combustion.

The aerodynamic design of a combustor front end is affected by the shape of the combustor liner and the swirl flow strength. Injectors utilize swirling flow to aid atomization of fuel and mix fuel with air to achieve a rich mixture within the combustor front end. Swirling flow with relatively high tangential velocity can cause recirculation within corner regions of the front end, which can interfere with cooling flows discharged along the combustor liners and increase temperatures of the combustor liner and shell. While past aerodynamic designs for combustor front ends are considered satisfactory for the intended purpose, further improvements to the aerodynamic design for reducing temperatures of the combustor liner and shell can further improve operational life of the combustor for RQL combustion.

SUMMARY

An injector according to an example embodiment of this disclosure includes a mount, a stem, a nozzle, and a swirler. The stem extends from a proximal end joined with the mount to a distal end. The nozzle extends from the distal end of the stem along an axis. The nozzle includes a center body coaxial with the axis and a fuel passage, which extends from the stem through the center body. The swirler circumscribes the center body and includes an inner air passage and an outer air passage. The inner air passage and the outer air passage extend through the swirler. The outer air passage is radially outward from the inner air passage relative to the axis. The inner air passage includes a plurality of inner vanes spaced circumferentially about the axis, each inner vane forming a first acute angle with a radial datum relative to the axis. The outer air passage includes a plurality of outer vanes spaced circumferentially about the axis, each outer vane forming a second acute angle with the radial datum that is less than the first acute angle.

A gas turbine engine according to a further example embodiment of this disclosure includes a combustor shell, a casing, a plurality of quench openings, and an injector. The combustor shell bounds a combustion chamber. The casing surrounds the combustor shell to form a plenum. The plurality of quench openings extends through the combustor shell that divides the combustion chamber into a primary zone upstream from the quench openings and a secondary zone downstream from the quench openings. The injector extends through the combustor shell into the primary zone. The injector includes a mount, a stem, a nozzle, and a swirler. The stem extends from a proximal end joined with the mount to a distal end. The nozzle extends from the distal end of the stem along an axis. The nozzle includes a center body coaxial with the axis and a fuel passage, which extends from the stem through the center body. The swirler circumscribes the center body and includes an inner air passage and an outer air passage. The inner air passage and the outer air passage extend through the swirler. The outer air passage is radially outward from the inner air passage relative to the axis. The inner air passage includes a plurality of inner vanes spaced circumferentially about the axis, each inner vane forming a first acute angle with a radial datum relative to the axis. The outer air passage includes a plurality of outer vanes spaced circumferentially about the axis, each outer vane forming a second acute angle with the radial datum that is less than the first acute angle.

DETAILED DESCRIPTION

As disclosed herein, injectors combine an inner air flow and an outer air flow to centralize a rich air-fuel mixture within the combustor front end. Swirl (i.e., tangential velocity) imposed on the inner air flow atomizes and mixes the inner air flow with fuel discharged into the combustor front end to produce a rich air-fuel mixture within a front end of the combustor. An inner recirculation region formed by a portion of the inner air flow stabilizes combustion within the primary zone. The outer air flow has little to no swirl to form an air barrier outward from the rich air-fuel mixture to retain combustion centrally within combustion chamber.

Figure 1:
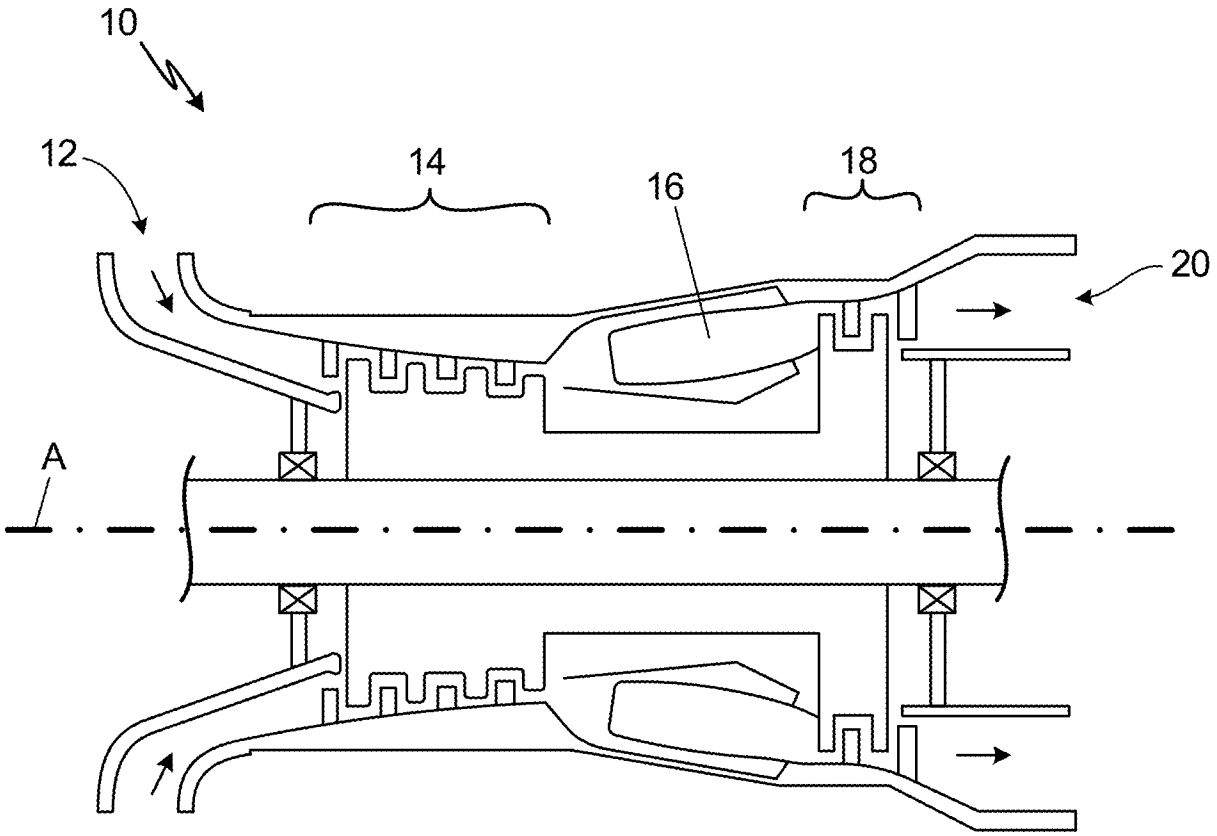
FIG. 1 is a schematic cross-sectional view of an example gas turbine engine.

FIG. 1 is a schematic cross-sectional view of gas turbine engine 10, which is depicted with single spool architecture. In other examples, gas turbine engine 10 can be configured with two spools (e.g., a dual-spool architecture), or more than two spools (e.g., a power turbine or a topping cycle spool non-concentrically arranged with respect to one or more primary spools). Gas turbine engine 10 can be configured as a propulsion engine, for example, a turbofan engine, a turboprop engine, or a turboshaft engine. In other examples, gas turbine engine 10 can be an industrial gas turbine engine driving a load (e.g., an electric machine). The architecture of gas turbine engine 10 depicts a forward-to-aft main gas flow path in which the engine ingests air into a forward portion of the engine that flows aft through the compressor section, the combustor, and the turbine section before discharging from an aft portion of the engine. In other examples, gas turbine engine 10 can have a reverse-flow architecture in which the engine ingests air into an aft portion of the engine that flows forward through the compressor section, the combustor, and the turbine section before discharging through an exhaust at a forward portion of the engine. Each compressor section and/or turbine section can have one or more stages. Each stage can include at least one rotor of circumferentially spaced blades and at least one stator of circumferentially spaced and stationary vanes. As depicted, gas turbine engine 10 includes multiple compressor stages and multiple turbine stages. However, other examples of gas turbine engine 10 can have more stages or less stages than the number of compressor stages and/or turbine stages depicted by FIG. 1.

As depicted in FIG. 1, gas turbine engine 10 includes, in serial flow communication, air inlet 12, compressor section 14, combustor 16, turbine section 18, and exhaust section 20. Compressor section 14 pressurizes air entering gas turbine engine 10 through air inlet 12. The pressurized air discharged from compressor section 14 mixes with fuel inside combustor 16. Igniters initiate combustion of the air-fuel mixture within combustor 16, which is sustained by a continuous supply of fuel and pressurized air and/or igniter activation. A heated and compressed air stream discharges through turbine section 18 and exhaust section 20. Turbine section 18 extracts energy from the exhaust stream to drive compressor section 14 and other engine accessories such as electrical generators and pumps for lubrication, fuel, and/or actuators.

Figure 2:
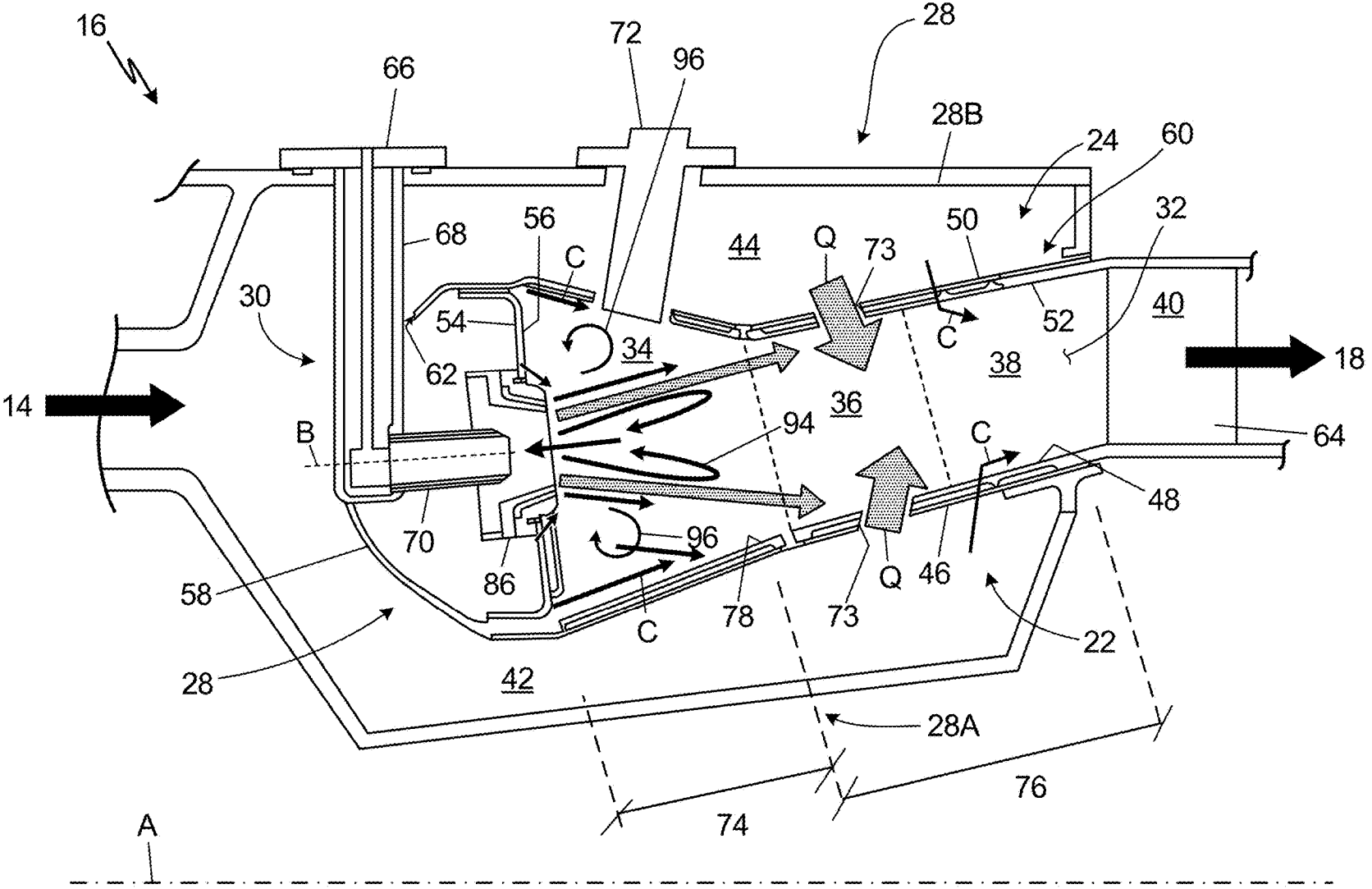
FIG. 2 is a schematic cross-sectional view of an example combustor of the gas turbine engine that includes injectors with low outer swirl flow.
Figure 3:
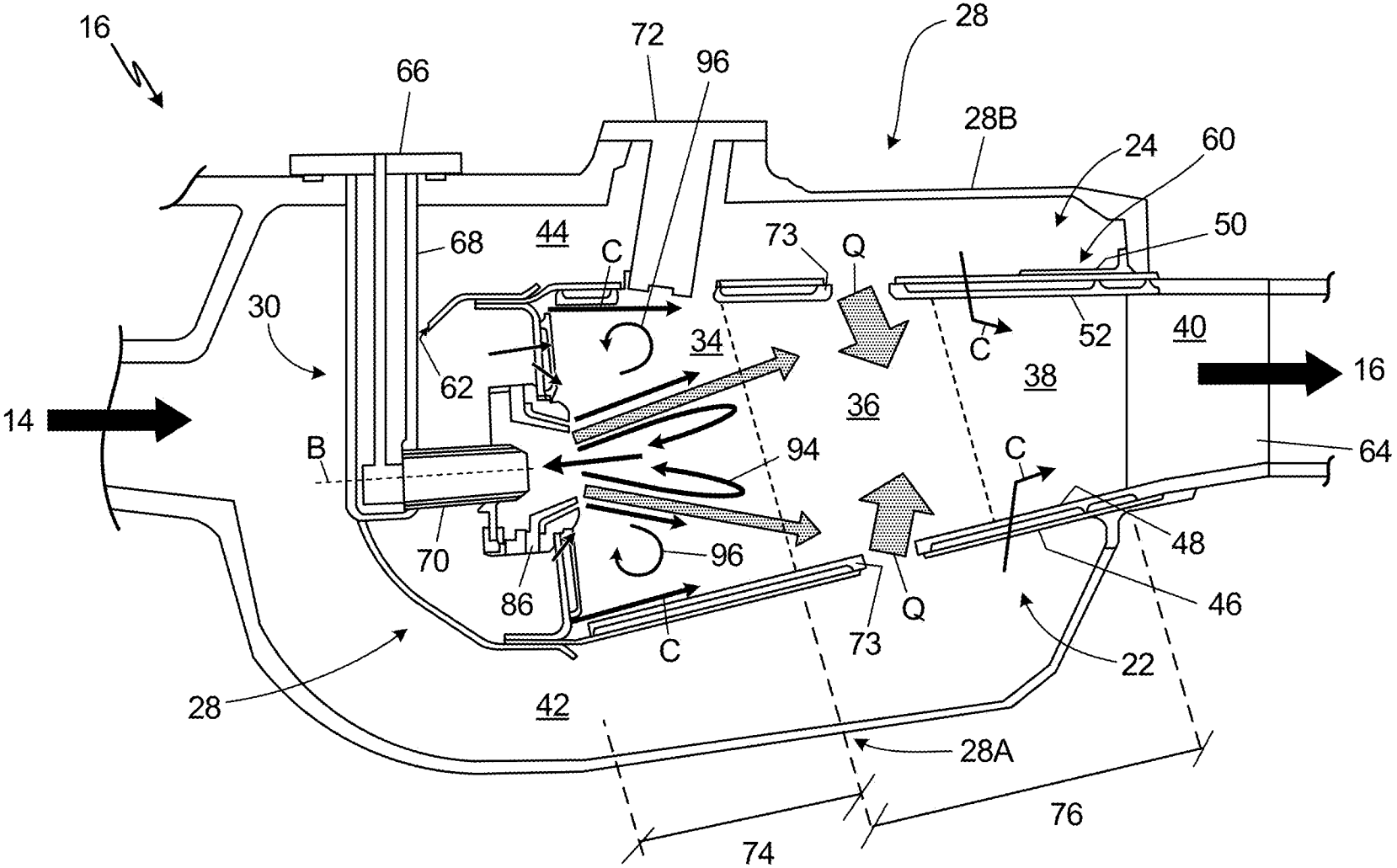
FIG. 3 is a schematic cross-sectional view of another example combustor of the gas turbine engine that includes injectors with low outer swirl flow.

FIG. 2 and FIG. 3 are schematic cross-sectional views of example combustors of gas turbine engine 10 configured for rich-quench-lean (RQL) combustion. FIG. 2 depicts a combustor with a kinked-wall configuration, and FIG. 3 depicts a combustor with a straight-wall configuration. Except where noted below, the combustors depicted by FIG. 2 and FIG. 3 are discussed together below. Further, while particular configurations of combustor 16 are illustrated and described below, other combustor types with various other details and configurations can benefit from features discussed below.

As depicted in FIG. 2 and FIG. 3, combustor 16 includes inner combustor liner assembly 22, outer combustor liner assembly 24, forward assembly 26, case module 28, and one or more injector 30. Inner combustor liner assembly 22 and outer combustor liner assembly 24 are spaced radially to define combustion chamber 32, which has an annular cross-sectional shape with respect to engine axis A.

Combustion chamber 32 includes, in axial flow series, primary zone 34, quench zone 36, secondary zone 38, and outlet 40. Primary zone 34 extends from forward assembly 26 to quench zone 36, and secondary zone 38 extends from quench zone 36 to outlet 40. Quench zone 36 is disposed between primary zone 34 and secondary zone 38. In operation, combustor 16 is configured to achieve a rich air-fuel ratio within at least a portion of primary zone 34, which transitions to a lean air-fuel ratio within secondary zone 38 by mixing air with the primary zone flow passing through quench zone 36.

Inner combustor liner assembly 22 is radially outward from inner case 28A of case module 28 to define inner annular plenum 42. Outer combustor liner assembly 24 is radially inward from outer case 28B of case module 28 to define outer annular plenum 44. Forward assembly 26 spans between and connects inner combustor liner assembly 22 to outer combustor liner assembly 24 and is located downstream from an inlet of combustor 16, which fluidly communicates with compressor section 14.

Inner combustor liner assembly 22 includes inner support shell 46 and one or more inner liner panels 48. Outer combustor liner assembly 24 includes outer support shell 50 and one or more outer liner panels 52. Forward assembly 26 includes bulkhead shell 54, one or more bulkhead liner panels 56, and annular hood 58. Inner liner panels 48 and outer liner panels 52 are circumferentially spaced and/or axially spaced to define an annular boundary to combustion chamber 32. Inner support shell 46 and outer support shell 50 are connected to inner liner panels 48 and outer liner panels 52 respectively to provide support thereto. Annular hood 58 extends between and is secured to upstream-most ends of inner support shell 46 and outer support shell 50. Annular hood 58, inner support shell 46, and outer support shell 50 collectively form combustor shell 60. Openings 62 extend through annular hood 58 for receiving injector 30 and receiving a portion of air from compressor section 14 within forward assembly 26. At opposite, downstream-most ends, inner support shell 46 and outer support shell 50 join to inlet guide vane assembly 64, which includes an array of circumferentially spaced stationary vanes. The cumulative open area between the stationary guide vanes defines outlet 40 of combustor 16, which fluidly communicates with turbine section 18.

Combustor 16 includes multiple injector 30 circumferentially spaced about engine axis A at forward assembly 26 of which, one injector is depicted by FIG. 2 and FIG. 3. Injector 30 can be supported from outer case 28B and extend radially inward through respective openings 62 in annular hood 58 to direct fuel through openings formed by bulkhead shell 54 and bulkhead liner panels 56.

Each injector 30 includes mount 66, stem 68, and nozzle 70, and injectors 30 are interconnected by a manifold (not shown). Some examples of injector 30 can include a heat shield (not shown) circumscribing at least a portion of stem 68 and/or nozzle 70. Each injector 30 inserts through a swirler for atomizing and mixing fuel and air, as well as provides an outer air barrier for separating the combustor shell and/or liners from the rich combustion zone. The following describes these features with respect to the depicted injector that is representative of each injector 30 fluidly communicating with combustion chamber 32.

Mount 66 supports injector 30 from outer case 28B of the gas turbine engine. One or more flanges, lips, and/or pilot diameters allow mount 66 to interface with outer case 28B. Mount 66 further includes one or more fasteners, keys, and/or pins for affixing injector 30 relative to outer case 28B and the combustor of gas turbine engine. As depicted, mount 66 is a flange that abuts an exterior of outer case 28B.

The manifold is outboard of mount 66 and includes supply lines fluidly communicating with a fuel source and/or one or more other adjacent injector 30. The manifold can include one or more pipes, conduits, hoses, and/or internal passages to define supply lines, which communicate with one or more fuel passages of stem 68.

Stem 68 extends longitudinally from mount 66 through outer case 28B into forward assembly 26 of combustor 16 as depicted, or into combustion chamber 32 in other examples. Stem 68 includes one or more fuel passages in fluid communication with one or more supply passages of the manifold.

Nozzle 70 extends from stem 68 through openings in bulkhead shell 54 and bulkhead liner panels 56 into combustion chamber 32. Nozzle 70 can include a center body and/or one or more annular bodies that include or cooperatively define one or more fuel discharge passages. Nozzle 70 inserts into and is circumscribed by swirler 86, which includes one or more air discharge passages. A net fuel discharge area of injector 30 is the summation of the flow-limiting areas of each fuel discharge passage, and a net air discharge area of injector 30 is the summation of flow-limiting areas of each air passage. For a given range of operational fuel pressure and plenum pressure of gas turbine engine 10, the net fuel discharge area and the net air discharge area of injector 30 can be varied to achieve a rich air-fuel mixture within primary zone 34. Fuel and air directed through nozzle 70 and swirler 86 provides an air-fuel mixture along axis B into primary zone 34 of combustion chamber 32. In some examples, at least some injectors 30 provide a continuous air-fuel mixture along axis B while other injectors 30 do not operate. In other examples, all injectors 30 provide a continuous air-fuel mixture along axis B of rejective injectors.

Igniters 72 are supported from outer case 28B and extend through outer combustor liner assembly 24 to communicate with combustion chamber 32. Igniters 72 are downstream relative to injector 30 such that igniters 72 are disposed between the axial locations of injector 30 and quench zone 36 along engine axis A. Igniters 72 activate to initiate combustion within combustion chamber 32 and deactivate during other phases of gas turbine engine operation.

Outer combustor liner assembly 24, inner combustor liner assembly 22, or both include openings 73 extending through the corresponding support shell and liners within quench zone 36 to provide quench flow Q. Openings 73 are distributed circumferentially about axis A and, in some examples, may include multiple rows of openings 73 spaced axially along axis A. Openings 73 can be equally distributed or unequally distributed about the circumference of combustor shell 60 and/or along axis A to achieve a quench flow distribution through openings 73. Openings are oriented to direct quench flow Q with a primary radial component with respect to engine axis A such that quench flow penetrates and mixes with a flow from primary zone 34. The area summation of openings 73 defines a net quench area, which can be varied in relation to the net fuel discharge area and net air discharge area to achieve a target quench flow relative to the primary air flow and/or combined air-fuel mixture flow. Additional openings 73 can extend through outer combustor liner assembly 24 and/or inner combustor liner assembly 22 within secondary zone to provide dilution air flow D.

Inner combustor liner assembly 22, outer combustor liner assembly 24, and/or forward assembly 26 can include multiple cooling holes (not shown) that extend through and/or between inner liner panels 48, outer liner panels 52, and/or bulkhead liner panels 56 for providing a distributed cooling flow into combustion chamber 32. Cooling holes are supplied by one or more supply holes extending through combustor shell 60 that places a backside of inner liner panels 48, outer liner panels 52, and/or bulkhead liner panels 56 in fluid communication with air from within inner annular plenum 42, outer annular plenum 44, and/or forward assembly 26. For example, near a junction between bulkhead liner panels 56 and outer liner panels 52 as well as between bulkhead liner panels 56 and inner liner panels 48, one or more cooling flows C can be directed axially along and substantially parallel with respective inner liner panels 48 and outer liner panels 52. Further, cooling flows C can be directed radially and/or circumferentially with respect to engine axis B and along bulkhead liner panels 56. Additional cooling flows C can be directed along different portions of inner liner panels 48, outer liner panels 52, and/or bulkhead liner panels 56 as needed to maintain temperatures of the liners and respective portions of combustor shell 60 within predetermined operational ranges. The net cooling flow C into combustion chamber 32 is the summation of flow from all cooling holes within one or more of primary zone 34, quench zone 36, and secondary zone 38.

As depicted in FIG. 2, inner combustor liner assembly 22 and outer combustor liner assembly 24 form front end region 74 that is contiguous with back end region 76. Within front end region 74, inner combustor liner assembly 22 and outer combustor liner assembly 24 form a converging annular cross-section in a direction from injector 30 towards outlet 40. Inner combustor liner assembly 22 and outer combustor liner assembly 24 within back end region 76 diverge relative to corresponding portions of inner combustor liner assembly 22 and outer combustor liner assembly 24 within front end region 74 to form a bend 78 at a junction between front end region 74 and back end region 76 (i.e., a kinked-wall configuration). Inner combustor liner assembly 22 and outer combustor liner assembly 24 can include a cross-sectional area that continues to decrease towards outlet 40, albeit at a lessor rate relative to the convergence within front end region 74 in some examples. While other examples of combustor 16, inner combustor assembly 22 and outer combustor assembly 24 can have a substantially constant cross-sectional area distribution from bend 78 to outlet 40.

As depicted in FIG. 3, inner combustor liner assembly 22 and outer combustor liner assembly 24 can be continuous within front end region 74 and back end region 76 such that a cross-sectional area of combustion chamber 32 decreases at a substantially constant rate towards outlet 40 (i.e., a straight-wall configuration). Straight-wall configurations of combustor 16 can push the combustion flame front further downstream towards quench openings 62 relative to kinked-wall configurations of combustor 16, which can contribute to reduced temperatures of the combustor shell and liners within front end region 74.

The air-fuel mixture within combustion chamber 32 can be described by an equivalence ratio, λ. As used herein, the air-fuel equivalence ratio is the ratio of the air mass flow rate to the fuel mass flow rate divided by the same ratio at the stoichiometry of the reaction considered. The air-fuel mixture within primary zone 34 is configured to include excess fuel relative to a stochiometric mixture of air and fuel (i.e., a rich mixture), which can be expressed by an air-fuel equivalence ratio less than 1.0. The air-fuel mixture within secondary zone 38 is configured to include excess air relative to the stochiometric mixture of air and fuel (i.e., a lean mixture, which can be expressed by an air-fuel equivalence ratio greater than 1.0.

In operation, nozzle 70 inject a mass flow rate of fuel and a mass air flow rate of air into primary zone 34 to produce a rich mixture of fuel and air. Initially, igniters 72 initiate combustion of the rich air-fuel mixture within primary zone 34, which becomes self-sustaining after combustion stabilizes within primary zone 34. The total flow from primary zone 34 mixes with air from quench flow Q within quench zone 36 to produce a lean air-fuel mixture within secondary zone 38. Cooling flow C dispensed into combustion chamber 32 mixes with and contributes to the air-fuel mixture in primary zone 34, quench zone 36, and/or secondary zone 38. In some examples, the lean air-fuel mixture is further mixed with dilution air flow D within secondary zone 38 before exiting via outlet 40 into turbine section 18.

Figure 5:
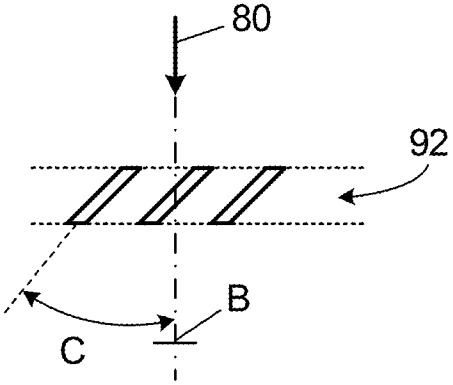
FIG. 5 is a partial developed view of inner air passage vanes from the injector depicted in FIG. 4.
Figure 7:
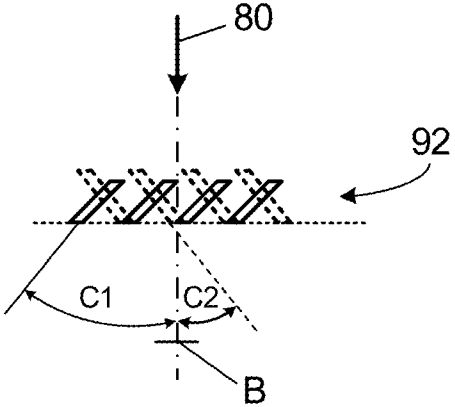
FIG. 7 is a partial developed view of inner air passage vanes from the injector depicted in FIG. 4 illustrating a counter-swirl inner air passage configuration.
Figure 6:
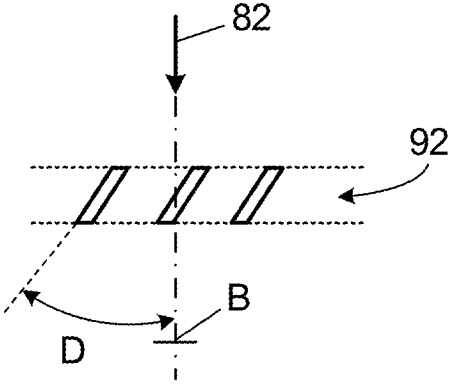
FIG. 6 is a partial developed view of outer air passage vanes from the injector depicted in FIG. 4.
Figure 4:
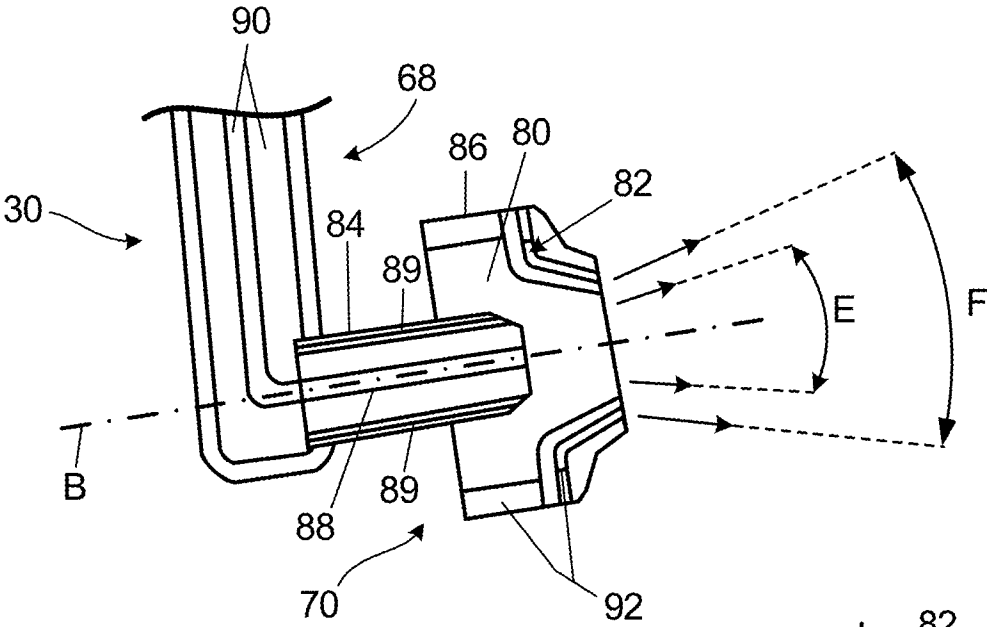
FIG. 4 is a schematic cross-sectional view of an injector of the combustor depicted by FIG. 2, or the combustor depicted by FIG. 3.

FIG. 4 is a schematic cross-sectional view of injector 30, which can be incorporated into combustor 16 as depicted by FIG. 2, or as depicted by FIG. 3. FIG. 5, FIG. 6, and FIG. 7 are partial developed views illustrating additional features of inner air passage 80 and outer air passage 82, which are discussed together with FIG. 4. Stem 68, nozzle 70, and swirler 86 are also depicted.

Nozzle 70 is disposed at a distal end of stem 68 and extends at least partially along axis B into combustion chamber 32. As depicted in FIG. 4, nozzle 70 includes center body 84 having at least fuel discharge passage 88, and in some examples, secondary fuel discharge passages 89. Nozzle 70 inserts into an swirler 86 that includes an inner air passage 80 and an outer air passage 82.

Center body 84 is a cylindrical, annular, or tubular body that extends from stem 68 along axis B to communicate with combustion chamber 32. Fuel discharge passage 88 fluidly communicates with fuel supply passage 90 of stem 68 and extends through center body 84 from stem 68 to fuel outlet 40 at a distal end of center body 84. Center body 84 can include one or more secondary fuel discharge passages 89 extending through center body 84 to fluidly connect fuel supply passage 90, or a secondary fuel supply passage (not shown), to secondary fuel outlets 41 at the distal end of center body 84. Each of fuel discharge passage 88 and secondary fuel passages 89 can have a circular or annular cross-sectional area. As shown in FIG. 4, fuel discharge passage 88 is coaxial with axis B and secondary fuel passages 89 are radially outward from axis B in a circumferentially spaced array about axis B.

Swirler 86 circumscribes center body 84 radially outward therefrom relative to axis B, and includes one or more annular bodies that are concentrically arranged with each other and/or center body 84. Swirler 86 can be joined to and supported by center body 84 and/or stem 68 in some examples. In other examples, swirler 86 can be supported from bulkhead shell 54 of forward assembly 26. Inner air passage 80 and outer air passage 82 extend through swirler 86 and/or is formed by space between two or more annular bodies of swirler 86, or between center body 84 and swirler 86. Positioned radially outward relative to fuel discharge passage 88, and secondary fuel discharge passage 89 if present, inner air passage 80 and outer air passage 82 can each include a single annular passage or an array of circumferentially spaces passages that circumscribe axis B.

Inner air passage 80 and outer air passage 82 each includes vanes 92 arranged in a circumferentially spaced array about axis B. Vanes 92 are arranged such that air flows from leading edges to trailing edges thereof along a radial direction relative to axis B. Each vane 92 of inner air passage 80 forms inner acute angle C with a radial datum of axis B as depicted in FIG. 5, and each vane 92 of outer air passage 82 forms outer acute angle D with a radial datum of axis B as depicted in FIG. 6. In certain examples, inner air passage 80 can include multiple axially-spaced rows of vanes 92 to form a counter-swirl inner air passage configuration as depicted in FIG. 7, such that a first row of vanes 92 forms first acute angle C1 and a second row of vanes 92 forms second inner acute angle C2, each with respect to a radial datum of axis B. Inner acute angle C1 and second inner acute angle C2 have opposite circumferential orientations. As depicted, first inner acute angle C1 imparts swirl in a first circumferential direction (e.g., clockwise about axis B) while second inner acute angle C2 imparts swirl in a second circumferential direction opposite the first circumferential direction (e.g., counterclockwise about axis B).

Downstream from vanes 92, walls of swirler 85 transition inner air passage 80 and outer air passage 82 from a radial direction to an axial direction relative to axis B. In operation, inner air passage 80 and outer air passage 82 fluidly communicate with air from inner annular plenum 42 and/or outer annular plenum 44 delivered into forward assembly 26 via one or more supply openings extending through combustor shell 60. Tangential velocity relative to axis B (e.g., swirl) can be imparted to air flowing through inner air passage 80 and outer air passage 82 by virtue of inner acute angles C and outer acute angles D of respective vanes 92, or by virtue of first inner acute angle C1, second inner acute angle C2, and outer acute angle D of respective vanes 92.

The magnitude of tangential velocity of inner and outer air flows (i.e., swirl strength) can be described by swirl number, which is the ratio of tangential velocity to axial velocity relative to axis B. As the swirl number increases, the tangential velocity divided by the axial velocity increases while a decreasing swirl number has tangential velocity divided by the axial velocity decreasing. The swirl number further impacts the angle at which the inner air flow and outer air flow diverge as described by inner divergence angle E and outer divergence angle F as shown in FIG. 2 and FIG. 3 in which inner divergence angle E and outer divergence angle F are included angles of the averaged inner air flow and the averaged outer air flow respectively.

Inner acute angles C (or first and second inner acute angles C1, C2) and outer acute angles D of vanes 92 are set to deliver the desired swirl angle to each of the airflow passages. The inner acute angle C (or C1, C2) of inner air passage 80 are configured to achieve a non-zero inner swirl number sufficient to establish the inner recirculation zone 94, an example of which is depicted by FIG. 2 and FIG. 3. In certain examples, the inner swirl number is between 0.5 and 0.71 ar. The outer acute angles D of outer air passage 82 are configured to impart little to no tangential velocity to air flowing therethrough in operation in order to create a diverging cone of air flow outward from inner recirculation zone 94. The maximum swirl number of outer air passage 82 (i.e., the outer swirl number) is selected based on geometry of combustor 16, mass fuel flow through fuel discharge passage 88, and mass flow through inner air passage 80 such that combustion is substantially retained within outer air flow throughout primary zone 34. In some examples, the outer swirl number is greater than or equal to zero and less than or equal to 2.5, or any included range therein. In further examples, the outer swirl number is greater than or equal to zero and less than or equal to 2.0. In still further examples, the outer swirl number is greater than or equal to zero and less than or equal to 1.5. In still further examples, the outer swirl number is greater than or equal to zero and less than or equal to 1.0. In still further examples, the outer swirl number is greater than or equal to zero and less than or equal to 0.5.

When outer air passage 82 of swirler 86 includes a non-zero swirl number configuration, the swirl direction (i.e., clockwise or counterclockwise about axis B) can be the same as the swirl direction of inner air passage 80 (i.e., co-swirl), or can be opposite the swirl direction of inner air passage 80 (i.e., counter-swirl). Co-swirl configurations of nozzle 70 benefit from lower shear velocity at boundaries between rich combustion flow and outer air flow, which produces less mixing between adjacent flows and thereby is more effective at shepherding the rich combustion flow downstream into quench zone 36.

Maintaining combustion of primary zone 34 inboard from inner combustor liner assembly 22 and outer combustor liner assembly 24 reduces temperatures of the combustion liner and combustion shell components as well as reduces or prevents interference with cooling flows along inner combustor liner assembly 22 and outer combustor liner assembly 24 by the combustion region. Further, lean air-fuel mixture regions develop local to inner combustor liner assembly 22 and outer combustor liner assembly 24 that reduce NOx production rate within combustion chamber 32. Strong inner and outer recirculation zones 96 adjacent forward assembly 26 improve cooling flow performance and reducing temperatures in these regions. As the primary flow enters quench zone 36, quench flow mixes with rich combustion flow to achieve a lean mixture within secondary zone 38 before discharging through outlet 40 into turbine section 18.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

An Injector with Low Outer Air Swirl

An injector, according to an example embodiment of this disclosure includes, among other possible things, a mount, a stem, a nozzle, and a swirler. The stem extends from a proximal end joined with the mount to a distal end. The nozzle extends from the distal end of the stem along an axis. The nozzle includes a center body and a fuel passage. The center body is coaxial with the axis, and the fuel passage extends through the center body. The swirler circumscribes the center body and includes an inner air passage and an outer air passage. The inner air passage and the outer air passage extend through the swirler. The outer air passage is radially outward from the inner air passage relative to the axis. The inner air passage includes a plurality of inner vanes spaced circumferentially about the axis, each inner vane forming a first acute angle with a radial datum relative to the axis. The outer air passage includes a plurality of outer vanes spaced circumferentially about the axis, each outer vane forming a second acute angle with the radial datum that is less than the first acute angle.

The injector of the preceding paragraph can optionally include, additionally and/or alternatively, any one or more of the following features, configurations and/or additional components.

A further embodiment of the foregoing injector, wherein the inner air passage and the outer air passage can have a co-swirl orientation.

A further embodiment of any of the foregoing injectors, wherein the inner air passage and the outer air passage can have a counter swirl orientation.

A further embodiment of any of the foregoing injectors, wherein the fuel passage can include a primary fuel discharge passage that is coaxial with the axis.

A further embodiment of any of the foregoing injectors, wherein the fuel passage can include a plurality of secondary fuel discharge passages forming a circumferential array radially outward from the primary fuel discharge passage.

A further embodiment of any of the foregoing injectors, wherein the inner acute angles of the plurality of inner vanes can be operatively associated with an inner swirl number.

A further embodiment of any of the foregoing injectors, wherein the outer acute angles of the plurality of outer vanes can be operatively associated with an outer swirl number.

A further embodiment of any of the foregoing injectors, wherein the outer swirl number can be less than the inner swirl number.

A further embodiment of any of the foregoing injectors, wherein the outer swirl number can be zero such that the outer air passage is configured to discharge an annular air current.

A further embodiment of any of the foregoing injectors, wherein the outer swirl number can be less than 2.5.

A further embodiment of any of the foregoing injectors, wherein the inner swirl number can be at least 0.5.

A further embodiment of any of the foregoing injectors, wherein the outer swirl number can be greater than or equal to 0.0 and less than or equal to 0.5.

A further embodiment of any of the foregoing injectors, wherein the inner swirl number can be greater than or equal to 0.5 and less than or equal to 0.7.

a Gas Turbine Engine with Injectors Having Low Outer Air Swirl

A gas turbine engine according to an example embodiment of this disclosure includes, among other possible things, a combustor shell, a casing, a plurality of quench openings, and an injector. The combustor shell bounds a combustion chamber. The casing surrounds the combustor shell to form a plenum. The plurality of quench openings extends through the combustor shell that divides the combustion chamber into a primary zone upstream from the quench openings and a secondary zone downstream from the quench openings. The injector extends through the combustor shell into the primary zone. The injector includes a mount, a stem, a nozzle, and a swirler. The stem extends from a proximal end joined with the mount to a distal end. The nozzle extends from the distal end of the stem along an axis. The nozzle includes a center body and a fuel passage. The center body is coaxial with the axis, and the fuel passage extends through the center body. The swirler circumscribes the center body and includes an inner air passage and an outer air passage. The inner air passage and the outer air passage extend through the swirler or is formed between radially adjacent annular bodies of the swirler, or between the swirler and the center body. The inner air passage includes a plurality of inner vanes spaced circumferentially about the axis, each inner vane forming a first acute angle with a radial datum relative to the axis. The outer air passage includes a plurality of outer vanes spaced circumferentially about the axis, each outer vane forming a second acute angle with the radial datum that is less than the first acute angle.

The gas turbine engine of the preceding paragraph can optionally include, additionally and/or alternatively, any one or more of the following features, configurations and/or additional components.

A further embodiment of the foregoing of gas turbine engine, wherein the second acute angles of the plurality of outer vanes can be operatively associated with an outer divergence angle.

A further embodiment of any of the foregoing gas turbine engines, wherein a projection of the outer divergence angle can intersect the combustor shell downstream from the primary zone.

A further embodiment of any of the foregoing gas turbine engines, wherein the inner air passage and the outer air passage can have a co-swirl orientation.

A further embodiment of any of the foregoing gas turbine engines, wherein the inner air passage and the outer air passage can have a counter swirl orientation.

A further embodiment of any of the foregoing gas turbine engines, wherein the fuel passage can be an annular fuel passage.

A further embodiment of any of the foregoing gas turbine engines, wherein the inner acute angles of the plurality of inner vanes can be operatively associated with an inner swirl number.

A further embodiment of any of the foregoing gas turbine engines, wherein the outer acute angles of the plurality of outer vanes can be operatively associated with an outer swirl number.

A further embodiment of any of the foregoing gas turbine engines, wherein the outer swirl number can be less than the inner swirl number.

A further embodiment of any of the foregoing gas turbine engines, wherein the outer swirl number can be zero such that the outer air passage is configured to discharge an annular air current.

A further embodiment of any of the foregoing gas turbine engines, wherein the outer swirl number can be less than 2.5.

A further embodiment of any of the foregoing gas turbine engines, wherein the inner swirl number can be at least 0.5

A further embodiment of any of the foregoing gas turbine engines, wherein the outer swirl number can be greater than or equal to 0.0 and less than or equal to 0.5.

A further embodiment of any of the foregoing gas turbine engines, wherein the inner swirl number can be greater than or equal to 0.5 and less than or equal to 0.7.

The invention claimed is:

1. An injector for a combustor of a gas turbine engine, the injector comprising:

a mount;

a stem extending from a proximal end joined with the mount to a distal end;

a nozzle extending from the distal end along an axis, the nozzle comprising:

a center body coaxial with the axis; and a fuel passage extending through the center body; and a swirler circumscribing the center body, the swirler comprising:

an inner air passage extending through the swirler; and an outer air passage extending through the swirler radially outward from the inner air passage;

wherein the inner air passage includes a plurality of inner vanes spaced circumferentially about the axis, each inner vane of the plurality of inner vanes forming a first acute angle with a radial datum relative to the axis to generate an inner recirculation zone in a chamber of the combustor, and wherein the outer air passage includes a plurality of outer vanes spaced circumferentially about the axis, each outer vane of the plurality of outer vanes forming a second acute angle with the radial datum that is less than the first acute angle, and the inner acute angles of the plurality of inner vanes are operatively associated with an inner swirl number to generate a diverging airflow cone outward of the recirculation zone, and wherein the outer acute angles of the plurality of outer vanes are operatively associated with an outer swirl number, and wherein the outer swirl number is less than the inner swirl number.

2. The injector of claim 1, wherein the inner air passage and the outer air passage have a co-swirl orientation.

3. The injector of claim 1, wherein the inner air passage and the outer air passage have a counter swirl orientation.

4. The injector of claim 1, wherein the fuel passage includes a primary fuel passage coaxial with the axis and a plurality of secondary fuel passages radially outward from the primary fuel passage.

5. The gas turbine engine of claim 1, wherein the outer swirl number is is greater than zero and less than or equal to 2.5.

6. The injector of claim 1, wherein the inner swirl number is greater than or equal to 0.5 and less than or equal to 0.7.

7. The injector of claim 1, wherein the outer swirl number is greater than 0.0 and less than or equal to 0.5.

8. The injector of claim 7, wherein the inner swirl number is greater than or equal to 0.5 and less than or equal to 0.7.

9. A gas turbine engine comprising:

a combustor shell that bounds a combustion chamber;

a casing surrounding the combustor shell to form a plenum;

a plurality of quench openings extending through the combustor shell that divides the combustion chamber into a primary zone upstream from the plurality of quench openings and a secondary zone downstream from the plurality of quench openings; and an injector extending through the combustor shell into the primary zone, the injector comprising:

a mount supported by the casing;

a stem extending from a proximal end joined with the mount to a distal end;

a nozzle extending from the distal end along an axis, the nozzle comprising:

a center body coaxial with the axis; and a fuel passage extending through the center body; and a swirler circumscribing the center body, the swirler comprising:

an inner air passage extending through the swirler; and an outer air passage extending through the swirler radially outward from the inner air passage;

wherein the inner air passage includes a plurality of inner vanes spaced circumferentially about the axis, each inner vane of the plurality of inner vanes forming a first acute angle with a radial datum relative to the axis to generate an inner recirculation zone in the combustion chamber, and wherein the outer air passage includes a plurality of outer vanes spaced circumferentially about the axis, each outer vane of the plurality of outer vanes forming a second acute angle with the radial datum that is less than the first acute angle to generate a diverging airflow cone outward of the recirculation zone, and wherein the second acute angles of the plurality of outer vanes are operatively associated with an outer divergence angle, and wherein a projection of the outer divergence angle intersects the combustor shell downstream from the primary zone.

10. The gas turbine engine of claim 9, wherein the inner air passage and the outer air passage have a co-swirl orientation.

11. The gas turbine engine of claim 9, wherein the fuel passage is an annular fuel passage.

12. The gas turbine engine of claim 9, wherein the inner acute angles of the plurality of inner vanes are operatively associated with an inner swirl number, and wherein the outer acute angles of the plurality of outer vanes are operatively associated with an outer swirl number, and wherein the outer swirl number is less than the inner swirl number.

13. The gas turbine engine of claim 12, wherein the outer swirl number is is greater than zero and less than or equal to 2.0.

14. The gas turbine engine of claim 12, wherein the outer swirl number greater than zero and less than or equal to 2.5.

15. The gas turbine engine of claim 14, wherein the inner swirl number is greater than or equal to 0.5 and less than or equal to 0.7.

16. The gas turbine engine of claim 12, wherein the outer swirl number is greater than 0.0 and less than or equal to 0.5.

17. The gas turbine engine of claim 16, wherein the inner swirl number is greater than or equal to 0.5 and less than or equal to 0.7.

* * * * *